US011763738B1

(12) United States Patent
Wang et al.

(10) Patent No.: US 11,763,738 B1
(45) Date of Patent: Sep. 19, 2023

(54) DISPLAY DRIVER CIRCUIT FOR LUMINANCE COMPENSATION AND FLICKERING REDUCTION AND METHOD OF OPERATING THE SAME

(71) Applicant: NOVATEK Microelectronics Corp., Hsin-Chu (TW)

(72) Inventors: Hung-I Wang, Hsinchu (TW); Yen-Tao Liao, Hsinchu (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 18/104,803

(22) Filed: Feb. 2, 2023

(51) Int. Cl.
*G09G 3/32* (2016.01)
*G09G 3/20* (2006.01)

(52) U.S. Cl.
CPC ..... *G09G 3/32* (2013.01); *G09G 3/2018* (2013.01); *G09G 2310/08* (2013.01); *G09G 2320/0233* (2013.01); *G09G 2320/0247* (2013.01); *G09G 2320/043* (2013.01); *G09G 2340/16* (2013.01)

(58) Field of Classification Search
CPC .... G09G 3/32; G09G 3/2018; G09G 2310/08; G09G 2320/0233; G09G 2320/0247; G09G 2320/043; G09G 2340/16
See application file for complete search history.

(56) References Cited

U.S. PATENT DOCUMENTS

| | | | | |
|---|---|---|---|---|
| 2017/0154557 | A1* | 6/2017 | Shon | G09G 3/3275 |
| 2018/0151121 | A1* | 5/2018 | Lim | G09G 3/2081 |
| 2019/0088199 | A1* | 3/2019 | Zhang | G09G 3/3258 |
| 2020/0202773 | A1* | 6/2020 | Genoe | G09G 3/3275 |

* cited by examiner

*Primary Examiner* — Andrew Sasinowski
(74) *Attorney, Agent, or Firm* — Winston Hsu

(57) ABSTRACT

A display driver circuit of controlling a display panel includes an emission compensation circuit and an emission optimization circuit. The emission compensation circuit generates an emission compensation estimate according to at least a gray level, an initial emission duty cycle, and a pulse count of a number of emission pulses in a data frame of the display panel. The emission optimization circuit is coupled to the emission compensation circuit and generates a compensated emission signal according to the initial emission duty cycle and the emission compensation estimate, and drive the display panel according to the compensated emission signal.

18 Claims, 8 Drawing Sheets

DISPLAY DRIVER CIRCUIT FOR LUMINANCE COMPENSATION AND FLICKERING REDUCTION AND METHOD OF OPERATING THE SAME

BACKGROUND OF THE INVENTION

1. Field of the Invention

The invention relates to emission control in display technology, and in particular, to a display driver circuit for luminance compensation and flickering reduction, and a method of operating the same.

2. Description of the Prior Art

Light-emitting diode (LED) displays are widely utilized in various electronic devices such as televisions, smartphones, tablet computers, and computer monitors. An LED display includes a matrix of pixels where pixel data and luminance are separately controlled in each pixel. Each pixel includes a storage capacitor for storing the pixel data. However, degradation of the pixel data in the storage capacitor may occur over time, leading to luminance decay and screen flickering between data frames.

In the related art, a variable refresh rate (VRR) is incorporated in the LED display to relieve the screen flickering, and gamma correction is adopted to compensate for the drop in luminance of the matrix of pixels resulting from VRR. However, as the grayscale value of each pixel is lower and/or the frame rate is lower, the gamma correction can no longer achieve luminance compensation, thus the screen flickering occurs.

SUMMARY OF THE INVENTION

According to an embodiment of the invention, a display driver circuit of controlling a display panel includes an emission compensation circuit and an emission optimization circuit. The emission compensation circuit generates an emission compensation estimate according to at least a reference gray level, an initial emission duty cycle, and a pulse count of a number of emission pulses in a data frame of the display panel. The emission optimization circuit is coupled to the emission compensation circuit and generates a compensated emission signal according to the initial emission duty cycle and the emission compensation estimate, and drive the display panel according to the compensated emission signal.

According to an embodiment of the invention, a display driver circuit includes an emission compensation circuit and an emission optimization circuit and a method of operating the display driver circuit includes the emission compensation circuit generating an emission compensation estimate according to at least a reference gray level, an initial emission duty cycle, and a pulse count of a number of emission pulses in a data frame of the display panel, and the emission optimization circuit generating a compensated emission signal according to the initial emission duty cycle and the emission compensation estimate, and drive the display panel according to the compensated emission signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
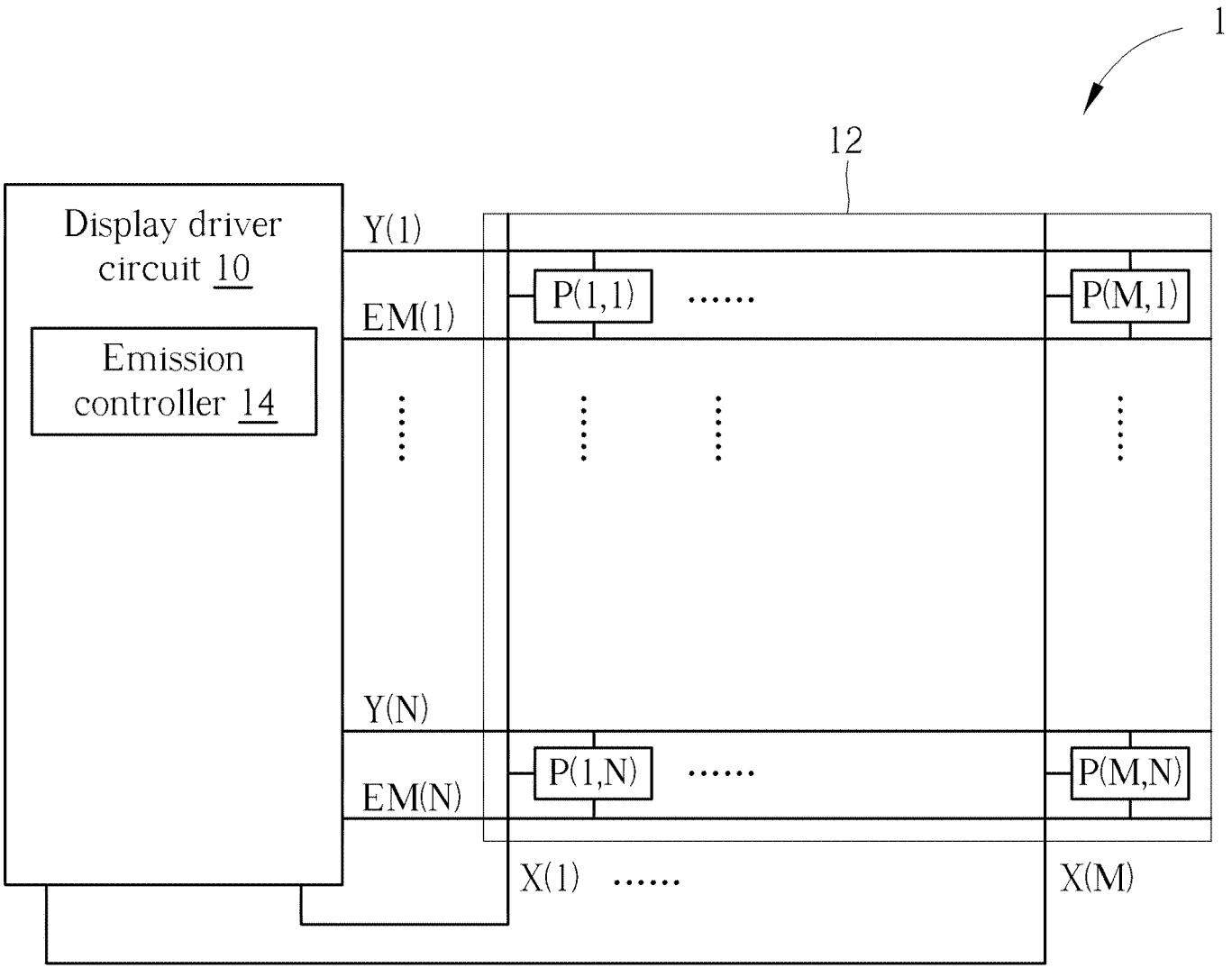
FIG. 1 is a schematic diagram of a display system according to an embodiment of the invention.

FIG. 1 is a schematic diagram of a display system 1 according to an embodiment of the invention. The display system 1 may include a display driver circuit 10 and a display panel 12 and may adopt variable refresh rate (VRR). The display panel 12 may be a light-emitting diode (LED) display, and may include pixels P(1,1) to P(M,N) arranged in a matrix, M, N being positive integers greater 1, e.g., M being equal to 1024, N being equal to 768. Each pixel of the pixels P(1,1) to P(M,N) may include an organic LED (OLED) display, a mini LED, a micro LED, or other-types of LEDs. The display driver circuit 10 may drive the pixels P(1,1) to P(M,N) to display a data frame, and may include an emission controller 14 to control luminances of the pixels P(1,1) to P(M,N).

The display driver circuit 10 may be coupled to the display panel 12 and control display operations according to data signals X(1) to X(M), scan signals Y(1) to Y(N), and emission signals EM(1) to EM(N). The display driver circuit 10 may load pixel data into pixels P(1,1) to P(M,N) sequentially from top to bottom and left to right using the scan signals Y(1) to Y(N) and the data signals X(1) to X(M), and may control luminance of the pixels P(1,1) to P(M,N) from top to bottom using the emission signals EM(1) to EM(N). For example, the display driver circuit 10 may set the scan signal Y(1) to enable the pixels P(1,1) to P(M,1) to load pixel data, set the data signal X(1) to transmit pixel data to the pixel P(1,1), and the emission controller 14 may set the emission signal EM(1) to control the luminances of the pixels P(1,1) to P(M,1). The pixel data may be represented by grayscale values.

The emission signals EM(1) to EM(N) may be PWM signals generated from a constant current source, and the duty cycles of the emission signals EM(1) to EM(N) may be adjustable from 0% to 100%. The duty cycles of the emission signals EM(1) to EM(N) may affect light emitting durations of each row of pixels, and consequently, affect the luminance of each row of pixels. The duty cycle of an emission signal is directly proportional to the luminance of the corresponding row of pixels. In some embodiments, the duty cycle of an emission signal may be negatively correlated to the luminance of the corresponding row of pixels, and the lower duty cycle of the emission signal would result in higher luminance of the corresponding row of pixels. In other embodiments, the duty cycle of an emission signal may be positively correlated to the luminance of the corresponding row of pixels, and the higher duty cycle of the emission signal would result in higher luminance of the corresponding row of pixels, and the higher duty cycle of the emission signal would result in higher luminance of the corresponding row of pixels.

Each pixel may include a storage capacitor to store charges representing the pixel data, but the charges may gradually leak off from the storage capacitor over time, reducing the charges held in the storage capacitor, leading to luminance decay and screen flickering. Moreover, as the frame rate decreases, the refresh rate of the display panel 12 may decrease, further escalating the luminance decay and the screen flickering.

The emission controller 14 may dynamically adjust the duty cycles of the R emission pulses in each data frame to compensate for the luminance decay owing to the charge leakage of the storage capacitor, thereby reducing or eliminating the screen flickering issue. In general, for a given pulse in the R emission pulses, the luminance decay may be linearly correlated to the level of luminance, and therefore, the compensation for the luminance decay may be estimated by interpolation.

Figure 2:
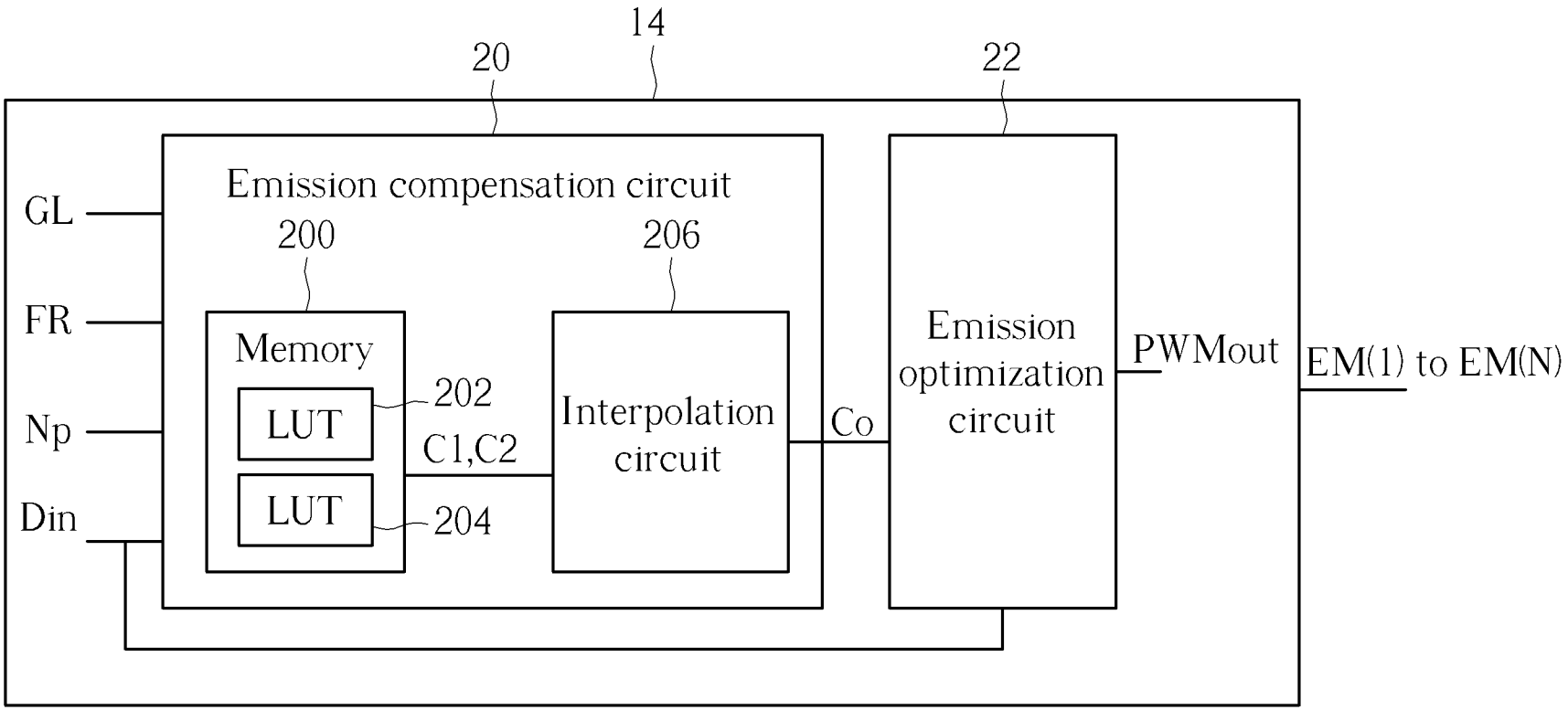
FIG. 2 is a block diagram of the emission controller in FIG. 1 according to an embodiment of the invention.
Figure 3:
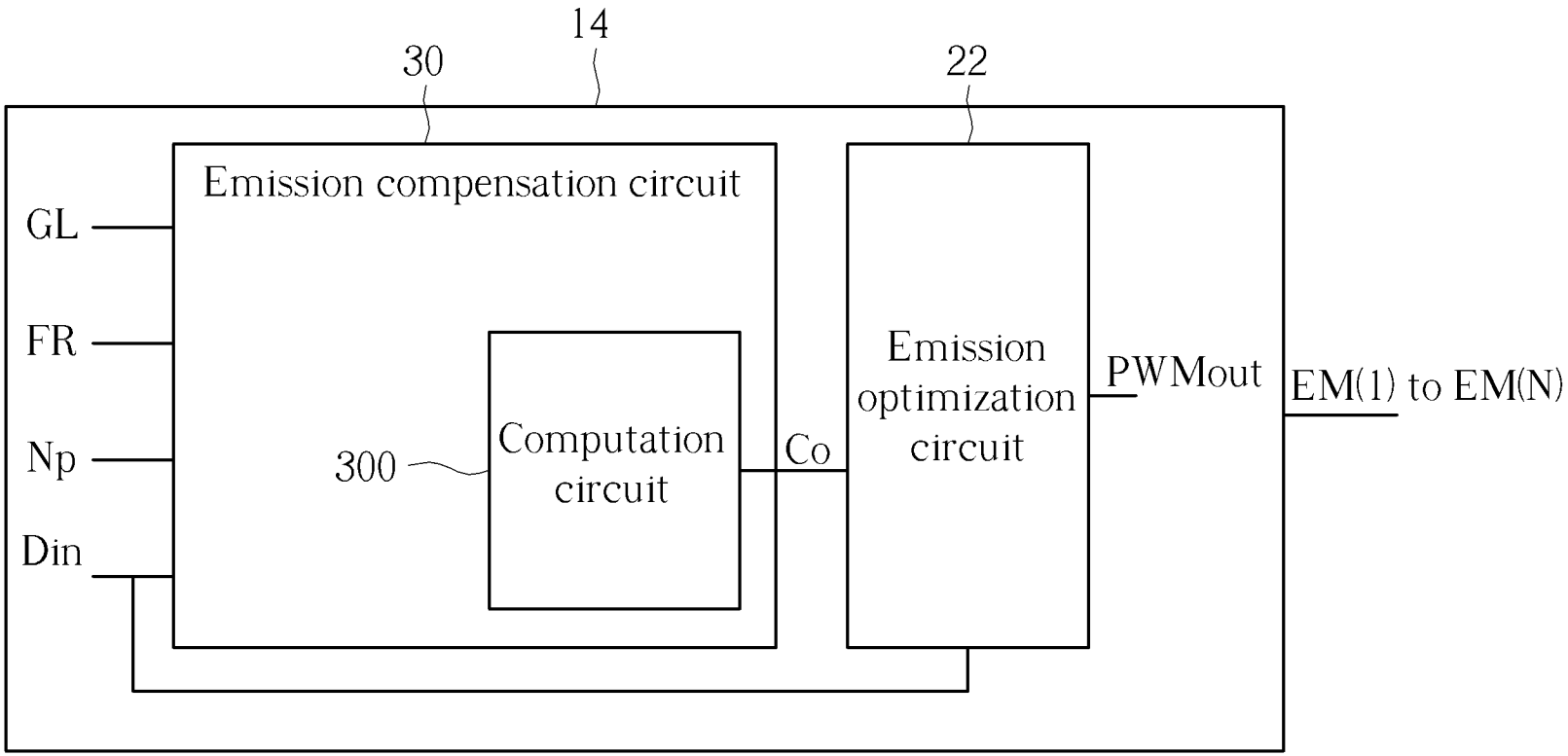
FIG. 3 is a block diagram of the emission controller in FIG. 1 according to an embodiment of the invention.

FIGS. 2 and 3 are block diagrams of the emission controller 14 according to two embodiments of the invention. In FIG. 2, the emission controller 14 may generate the emission compensation estimates Co for the R emission pulses in each data frame by interpolation. In FIG. 3, the emission controller 14 may generate the emission compensation estimates Co for the R emission pulses in each data frame by computing a value of a function.

Referring to FIG. 2, the emission controller 14 may receive a reference gray level GL, a frame rate FR of the display panel 12, a pulse count Np of the R emission pulses in each data frame of the display panel 12, and an initial emission duty cycle Din, adjust the duty cycles of the R emission pulses accordingly, and output the R emission pulses of the emission signals EM(1) to EM(N) to drive the display panel 12.

The emission controller 14 may include an emission compensation circuit 20 and an emission optimization circuit 22. The emission compensation circuit 20 may generate an emission compensation estimate Co according to at least the reference gray level GL, the initial emission duty cycle Din, and the pulse count Np of the R emission pulses in the data frame of the display panel 12, Np being a positive integer ranging between 1 and R.

The emission compensation circuit 20 may generate R emission compensation estimates Co in each data frame. The initial duty cycles Din may be a digital signal representing a duty cycle of an uncompensated emission signal. The initial duty cycles Din and the emission compensation estimate Co may be represented by a time, a percentage of a pulse period, a sweep time of a number of emission lines, or other suitable units of time. For example, for a frame rate of 30 Hz and N=768, the sweep time of 10 emission line is 0.43 ms (=10/(30*768)). The initial duty cycles Din and the emission compensation estimate Co may be represented by the same unit to simplify subsequent computations, e.g., the initial duty cycles Din may be a sweep time of 48 emission lines, and the emission compensation estimate Co may be a sweep time of 5 emission lines. In some embodiments, the reference gray level GL may be a predetermined value selected from 128 to 255, e.g., the predetermined value may be 192. In other embodiments, the reference gray level GL may be an average gray level of a predetermined range in a previous data frame, e.g., the average gray level of all pixel data in the previous data frame.

The emission optimization circuit 22 may be coupled to the emission compensation circuit 20 and may generate a compensated emission signal PWMout according to the initial emission duty cycle Din and the emission compensation estimate Co, and drive the display panel 12 according to the compensated emission signal PWMout. In some embodiments, the emission optimization circuit 22 may generate the duty cycle of the compensated emission signal PWMout according to the initial emission duty cycle Din and the emission compensation estimate Co, so as to generate R duty cycles of R emission pulses in the compensated emission signal PWMout in each data frame, the R duty cycles being equal to or different from each other. In some embodiments, the emission controller 14 may adjust the duty cycle of an emission pulse according to a reference gray level GL and an initial emission duty cycle Din to enable the duty cycle of the emission pulse to be positively correlated to the reference gray level GL and/or the initial emission duty cycle Din. That is, the duty cycle may be reduced as the reference gray level GL and/or the initial emission duty cycle Din reduces. The emission optimization circuit 22 may further output the compensated emission signal PWMout as the emission signals EM(1) to EM(N) to drive the display panel 12.

The emission compensation circuit 20 may include a memory 200 and an interpolation circuit 206. The interpolation circuit 206 may be coupled to the memory 200 and the emission optimization circuit 22. The memory 200 may include a plurality of lookup tables (LUT) associated with various combinations of luminances, frame rates and/or numbers of emission pulses. Prior to estimating an emission compensation estimate Co, the emission compensation circuit 20 may multiply the reference gray level GL and the initial emission duty cycle Din to generate a target luminance. A LUT 202 in the plurality of LUTs may be associated with a first luminance, a predetermined frame rate, and a predetermined number of emission pulses, and a LUT 204 in the plurality of LUTs may be associated with a second luminance, the predetermined frame rate, and the predetermined number of emission pulses, the target luminance being between the first luminance and the second luminance. For example, the predetermined frame rate may be 30 frames per second, the predetermined number of emission pulses may be 8, the target luminance may be 266 nits, the first luminance may be 260 nits, and the second luminance may be 270 nits. The LUT 202 may store data pairs of pulse counts Np of the R emission pulses in a data frame and corresponding emission compensation estimates C1 for the first luminance. Likewise, the LUT 204 may store data pairs of pulse counts Np of the R emission pulses in the data frame and corresponding emission compensation estimates C2 for the second luminance.

The interpolation circuit may check the LUT 202 according to the pulse count Np to determine the corresponding emission compensation estimate C1 for the first luminance, check the second lookup table according to the pulse count Np to determine the corresponding emission compensation estimate C2 for the second luminance, and perform an interpolation between the corresponding emission compensation estimate C1 for the first luminance and the corresponding emission compensation estimate C2 for the second luminance to generate the emission compensation estimate Co of the target luminance. For example, if Np=3, the corresponding emission compensation estimate C1 for 260 nits may be 10 emission lines, the corresponding emission compensation estimate C2 for the 270 nits may be 0 emission lines, and the interpolation circuit 206 may approximate the emission compensation estimate Co of the target luminance (=266 nits) as 4 emission lines.

If the emission compensation estimate Co is positive in value, the emission optimization circuit 22 may decrease the initial emission duty cycle Din by the emission compensation estimate Co to update the duty cycle of an emission pulse in the compensated emission signal PWMout, and if the emission compensation estimate Co is negative in value, the emission optimization circuit 22 may increase the initial emission duty cycle Din by the emission compensation estimate Co to update the duty cycle of an emission pulse in the compensated emission signal PWMout. In this manner, the emission optimization circuit 22 may updates the R duty cycles of the R emission pulses in the compensated emission signal PWMout.

Referring to FIG. 2 and FIG. 3, the emission controller 14 in FIG. 3 is different from FIG. 2 in that the memory 200 and the interpolation circuit 206 are replaced by a computation circuit 300. Therefore, the following discussion for FIG. 3 will be focused on the computation circuit 300.

The computation circuit 300 may be coupled to the emission optimization circuit 22 and may generate the emission compensation estimate Co. In some embodiments, the emission compensation circuit 30 may generate the emission compensation estimate Co according to the reference gray level GL, the initial emission duty cycle Din, the pulse count Np, and the frame rate FR. The emission compensation circuit 30 may compute the emission compensation estimate Co by a function of the reference gray level GL, the initial emission duty cycle Din, the pulse count Np, and the frame rate FR, as expressed by Equation Eq(1):

$$Co=F(GL, Din, Np, FR) \quad \text{Eq(1)}$$

In some embodiments, the emission compensation estimate Co may be positively correlated to the pulse count Np and the frame rate FR, and negatively correlated to the reference gray level GL and the initial emission duty cycle Din. In some embodiments, each lookup table in the memory 200 may store a plurality of sets of the reference gray level GL, the initial emission duty cycle Din, the pulse count Np, and the frame rate FR.

In other embodiments, the emission compensation circuit 30 may generate the emission compensation estimate Co according to the reference gray level GL, the initial emission duty cycle Din, the pulse count Np, and the number R of emission pulses per data frame. The number R of emission pulses per data frame may be predefined and stored in a register in the computation circuit 300, e.g., R=8. The emission compensation circuit 30 may compute the emission compensation estimate Co by a function of the reference gray level GL, the initial emission duty cycle Din, the pulse count Np, and the number R of emission pulses per data frame, as expressed by Equation Eq(2):

$$Co=F(GL, Din, Np, R) \quad \text{Eq(2)}$$

In some embodiments, the emission compensation estimate Co may be positively correlated to the pulse count Np and the number R, and negatively correlated to the reference gray level GL and the initial emission duty cycle Din. In some embodiments, each lookup table in the memory 200 may store a plurality of sets of the reference gray level GL, the initial emission duty cycle Din, the pulse count Np, and the number R.

In other embodiments, the emission compensation circuit 30 may generate the emission compensation estimate Co according to the reference gray level GL, the initial emission duty cycle Din, the pulse count Np, the frame rate FR, and the number R of emission pulses per data frame. The emission compensation circuit 30 may compute the emission compensation estimate Co by a function of the reference gray level GL, the initial emission duty cycle Din, the pulse count Np, the frame rate FR, and the number R of emission pulses per data frame, as expressed by Equation Eq(3):

$$Co=F(GL, Din, Np, FR, R) \quad \text{Eq(3)}$$

In some embodiments, the emission compensation estimate Co may be positively correlated to the pulse count Np, the frame rate FR and the number R, and negatively correlated to the reference gray level GL and the initial emission duty cycle Din. In some embodiments, each lookup table in the memory 200 may store a plurality of sets of the reference gray level GL, the initial emission duty cycle Din, the pulse count Np, the frame rate FR, and the number R.

Figure 4:
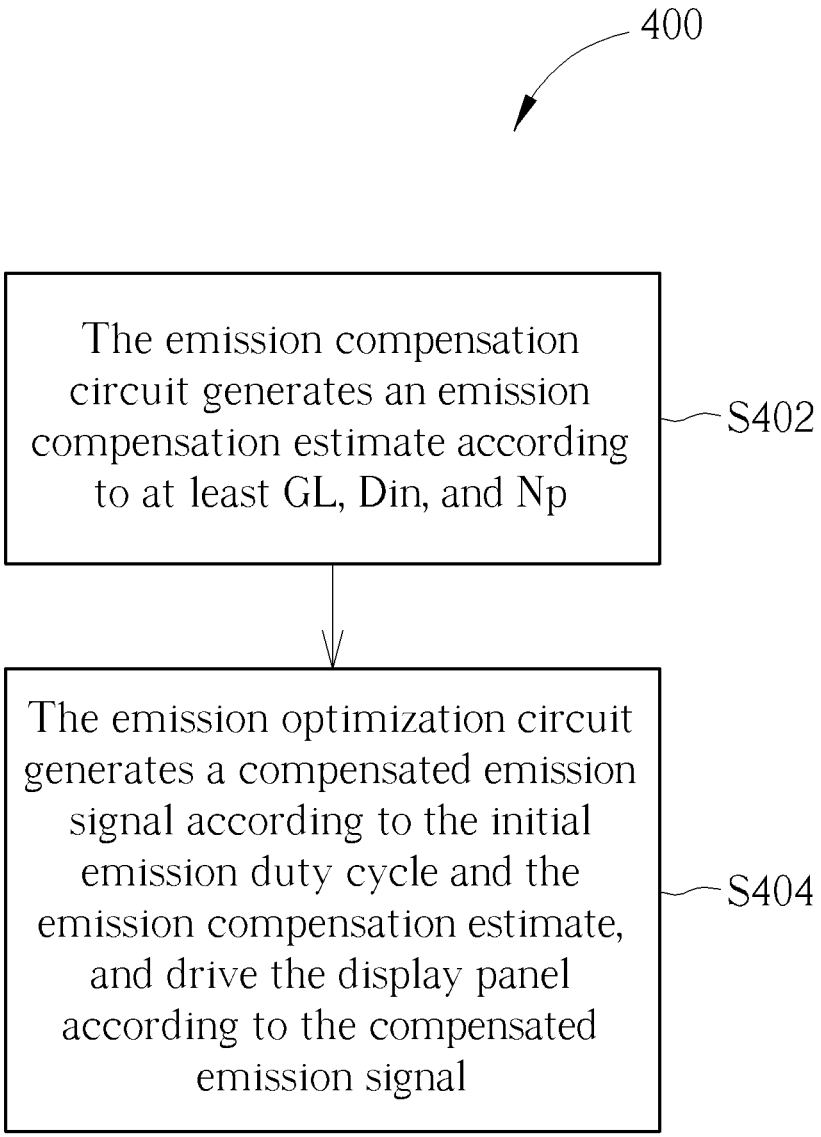
FIG. 4 is a flowchart of a method of operating the emission controller in FIG. 2 or FIG. 3.

FIG. 4 is a flowchart of a method 400 of operating the emission controller 14 in FIG. 2 or FIG. 3. The method 400 includes Steps S402 and S404 for dynamically adjust the duty cycles of the R emission pulses in each data frame. Any reasonable step change or adjustment is within the scope of the disclosure. Steps S402 and S404 are detailed as follows:

Step S400: The emission compensation circuit generates an emission compensation estimate Co according to at least at least the reference gray level GL, the initial emission duty cycle Din, and the pulse count Np in a data frame of the display panel;

Step S402: The emission optimization circuit generates a compensated emission signal PWMout according to the initial emission duty cycle Din and the emission compensation estimate Co, and drive the display panel according to the compensated emission signal PWMout.

Explanation for Steps S402 and S404 can be found in the preceding paragraphs and will be omitted here for brevity.

Figure 5:
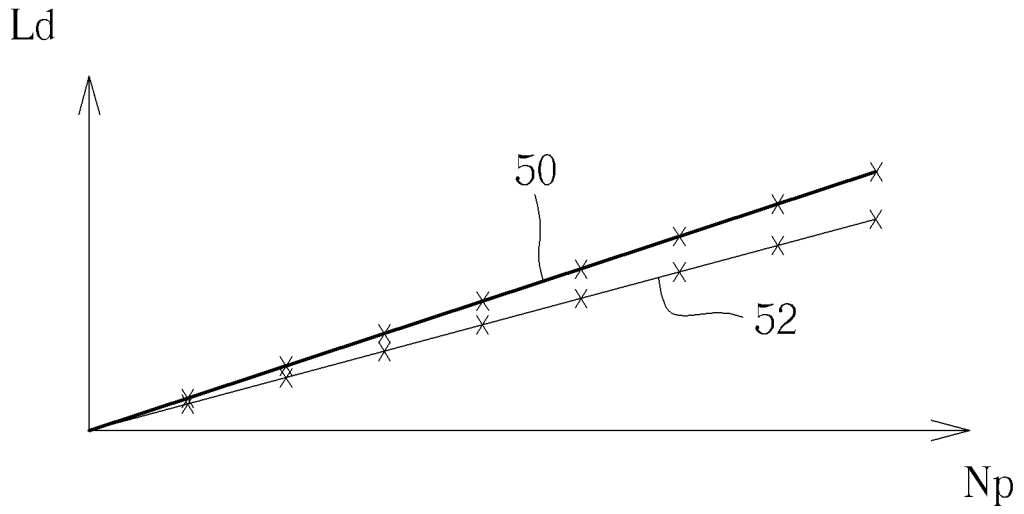
FIG. 5 shows the luminance decay in relation to the pulse count in a data frame.

FIG. 5 shows the luminance decay Ld in relation to the pulse count Np in a data frame, where the horizontal axis represents the pulse count Np and the vertical axis represents the amount of luminance decay Ld. Line 50 shows the luminance decay Ld of a high duty cycle of the sweep time of 20 emission lines, and Line 52 shows the luminance decay Ld of a low duty cycle of the sweep time of 6 emission lines. FIG. 5 shows that the luminance decay Ld is positively correlated to the pulse count Np regardless of the duty cycle being high or low. Moreover, FIG. 5 further shows that the luminance decay Ld is linearly correlated to the duty cycle, and the luminance decay Ld of the high duty cycle is higher than the luminance decay Ld of low duty cycle.

Figure 6:
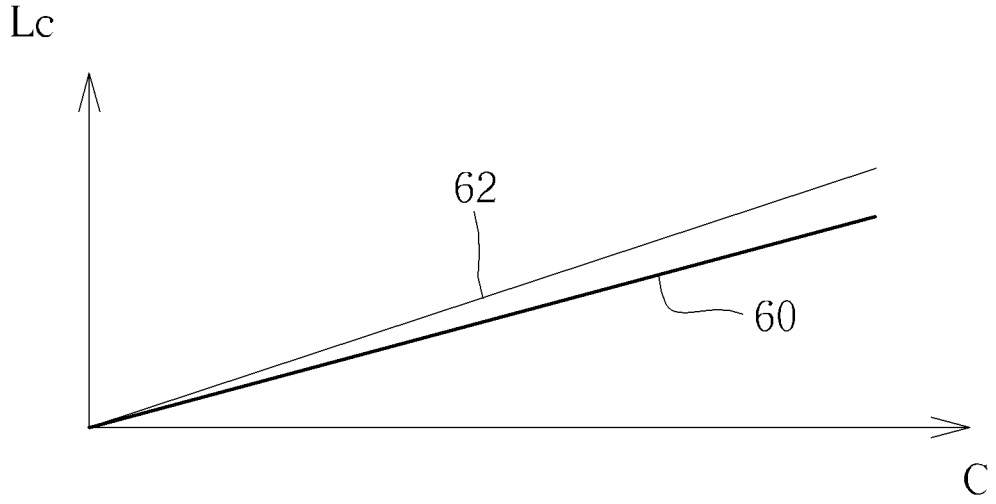
FIG. 6 shows the emission compensation estimate in relation to the lamination compensation.

FIG. 6 shows the emission compensation estimate in relation to the lamination compensation, where the horizontal axis represents the emission compensation estimate C and the vertical axis represents the amount of luminance compensation Lc. Line 60 shows the luminance compensation Lc of the low duty cycle of the sweep time of 6 emission lines, and Line 62 shows the luminance compensation Lc of the high duty cycle of the sweep time of 20 emission lines. FIG. 6 shows that the luminance compensation Lc is positively correlated to the emission compensation estimate C regardless of the duty cycle being high or low. Moreover, FIG. 6 further shows that the luminance compensation Lc is linearly correlated to the duty cycle, and the luminance compensation Lc of the low duty cycle is higher than the luminance compensation Lc of high duty cycle.

Figure 7:
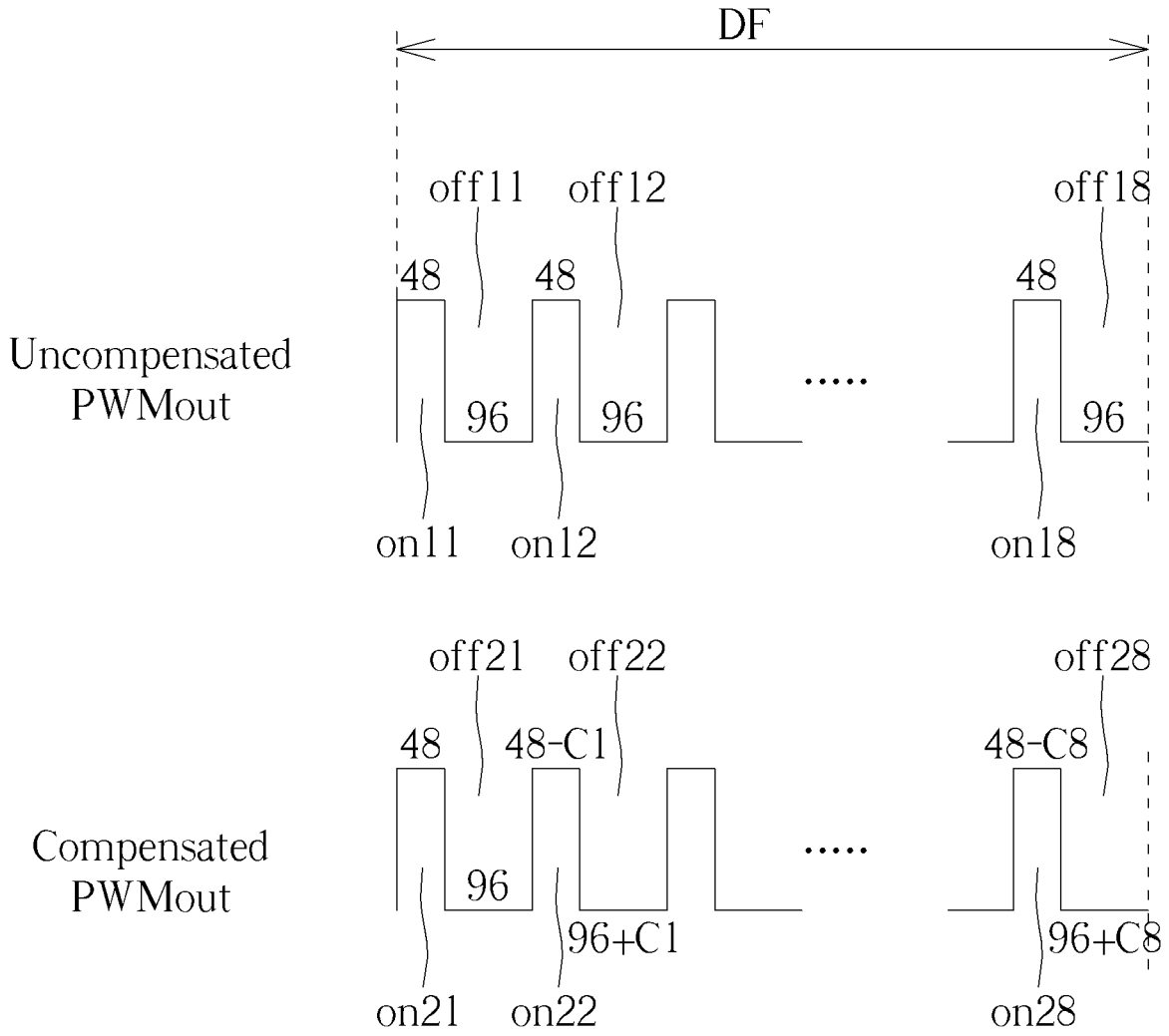
FIG. 7 is a timing diagram of an uncompensated emission signal and a compensated emission signal.

FIG. 7 is a timing diagram of an uncompensated emission signal PWMout and a compensated emission signal PWMout. In a data frame DF, the uncompensated emission signal PWMout and the compensated emission signal PWMout each includes 8 emission pulses. The 8 emission pulses have equal emission periods, and each emission pulse includes an ON time and an OFF time. For example, in the uncompensated emission signal PWMout, the first emission pulse includes an ON time on11 and an OFF time off11, and in the compensated emission signal PWMout, the first emission pulse includes an ON time on21 and an OFF time off21. In the uncompensated emission signal PWMout, the 8 emission pulses are equal in ON times and equal in OFF times. For example, the ON times on11 to on18 are equal to the sweep time of 48 emission lines, and the OFF times off11 to off18 are equal to the sweep time of 96 emission lines. Therefore, the duty cycles of the 8 emission pulses in the uncompensated emission signal PWMout are equal to each other, resulting in undesired luminance decay and screen flickering of a display panel.

In the compensated emission signal PWMout, the 8 emission pulses may be different in ON times and different in OFF times. For example, the ON times on11 to on18 are different to each other, with the ON time on21 being the sweep time of 48 emission lines, the ON time on21 being the sweep time of (48−C1) emission lines, . . . , and the ON time on28 being the sweep time of (48−C8) emission lines, the OFF time off21 being the sweep time of 48 emission lines, the OFF time off21 being the sweep time of (48+C1) emission lines, . . . , and the OFF time off28 being the sweep time of (48+C8) emission lines, C1, C2, . . . , C8 being the emission compensation estimates. Therefore, the duty cycles of the 8 emission pulses in the compensated emission signal PWMout are different from each other, so as to maintain a constant luminance of the display panel 12 in each data frame DF, and significantly reduce screen flickering.

Figure 8:
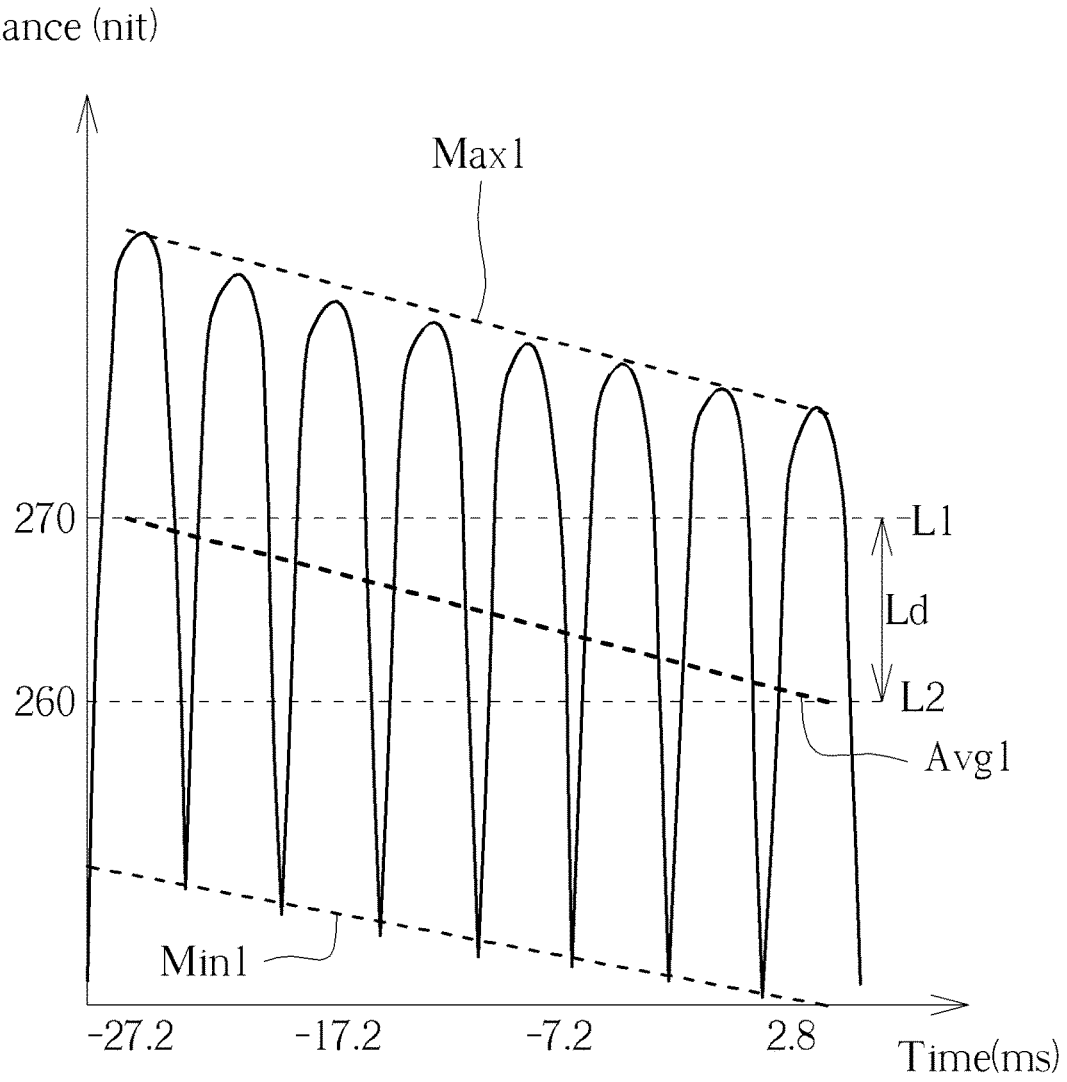
FIG. 8 is a timing diagram of uncompensated luminance in a data frame.

FIG. 8 is a timing diagram of uncompensated luminance in a data frame for a frame rate of 30 Hz, a reference gray level of 192, and an initial emission duty cycle Din of 9.95%, where the horizontal axis represents time in milliseconds (ms) and the vertical axis represents uncompensated luminance in nit. FIG. 8 shows that a maximum trendline Max1, a minimum trendline Min1, and an average trendline avg1 of the uncompensated luminance all decrease with time. A difference between a start average luminance L1 and an end average luminance L2 on the average trendline avg1 is referred to as a luminance decay Ld (Ld=L1−L2). The luminance decay Ld would lead to screen flickering of the display panel 12. For example, the start average luminance L1 may be 270 nits, the end average luminance L2 may be 260 nits, and the luminance decay Ld may be 10 nits, leading to a luminance drop in one frame and screen flickering between consecutive frames.

Figure 9:
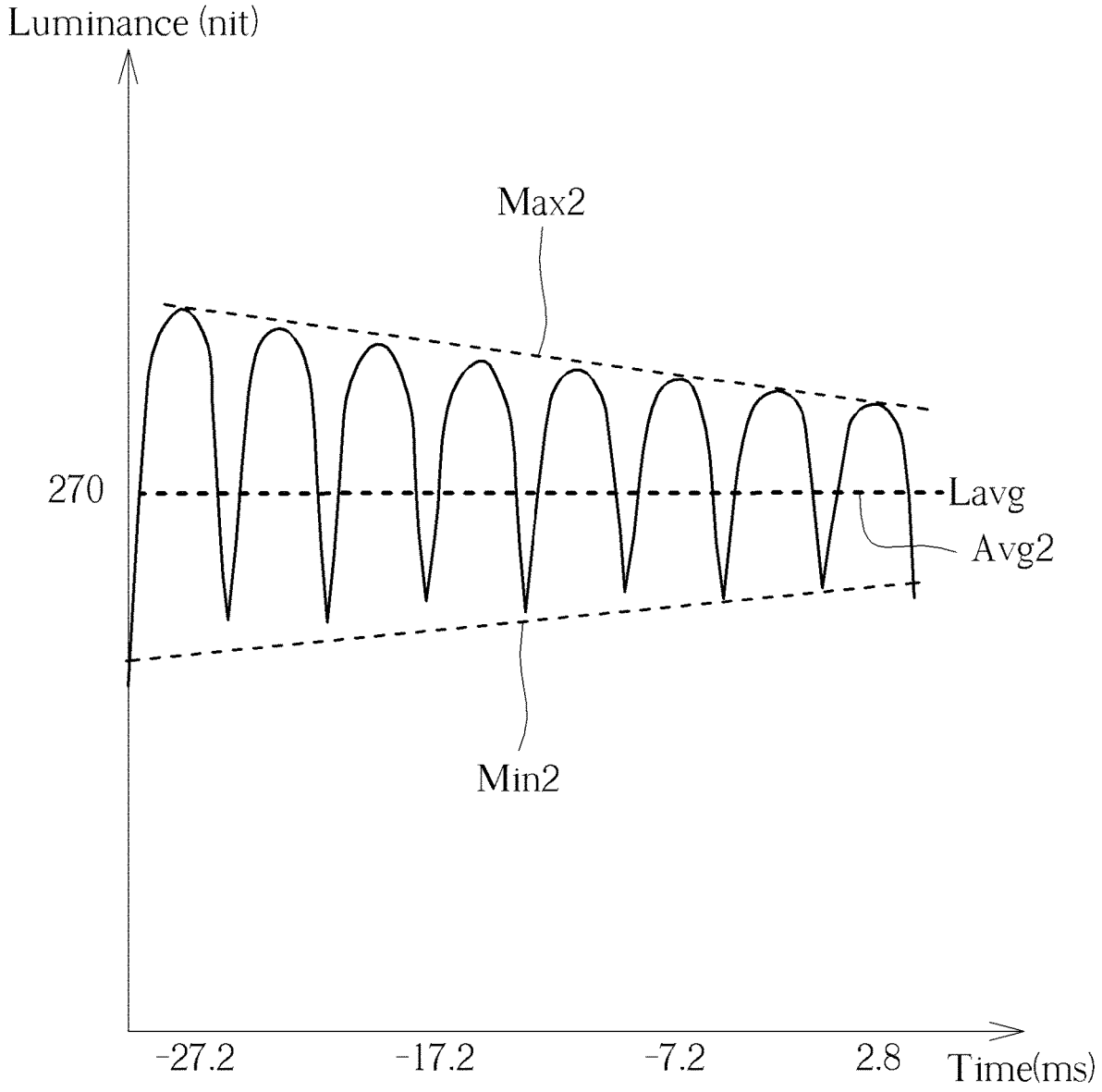
FIG. 9 is a timing diagram of compensated luminance in a data frame.

FIG. 9 is a timing diagram of compensated luminance in a data frame for a frame rate of 30 Hz, a reference gray level of 192, and an initial emission duty cycle Din of 9.95%, where the horizontal axis represents time in ms and the vertical axis represents uncompensated luminance in nit. FIG. 9 shows that a maximum trendline Max2 of the compensated luminance slightly decreases with time, a minimum trendline Min2 of the compensated luminance slightly increases with time, and an average trendline Avg2 of the compensated luminance remains constant at a luminance level Lavg, leading to no luminance decay and no screen flickering of the display panel 12. For example, the average trendline Avg2 is maintained at a luminance level Lavg of 270 nits, resulting in no luminance decay and no screen flickering.

The embodiments of the invention disclose the display driver circuit and the method of operating the same for compensating luminance decay and reducing screen flickering, enhancing performance of an LED display.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display driver circuit of controlling a display panel, the display driver circuit comprising:

an emission compensation circuit to generate an emission compensation estimate according to at least a reference gray level, an initial emission duty cycle, and a pulse count of a number of emission pulses in a data frame of the display panel; and an emission optimization circuit coupled to the emission compensation circuit and to generate a compensated emission signal according to the initial emission duty cycle and the emission compensation estimate, and drive the display panel according to the compensated emission signal.

2. The display driver circuit of claim 1, wherein the emission compensation circuit multiplies the reference gray level and the initial emission duty cycle to generate a target luminance, and the emission compensation circuit comprises:

a memory comprising a first lookup table storing a data pair of the pulse count and a corresponding emission compensation estimate for a first luminance, and a second lookup table storing a data pair of the pulse count and a corresponding emission compensation estimate for a second luminance; and an interpolation circuit coupled to the memory and checks the first lookup table according to the pulse count to determine the corresponding emission compensation estimate for the first luminance, check the second lookup table according to the pulse count to determine the corresponding emission compensation estimate for the second luminance, and perform an interpolation between the corresponding emission compensation estimate for the first luminance and the corresponding emission compensation estimate for the second luminance to generate the emission compensation estimate of the target luminance, the target luminance being between the first luminance and the second luminance.

3. The display driver circuit of claim 1, wherein the emission compensation circuit generates the emission compensation estimate according to the reference gray level, the initial emission duty cycle, the pulse count, and a frame rate of the display panel.

4. The display driver circuit of claim 1, wherein the emission compensation circuit generates the emission compensation estimate according to the reference gray level, the initial emission duty cycle, the pulse count, and the number of emission pulses per data frame.

5. The display driver circuit of claim 1, wherein the emission compensation circuit generates the emission compensation estimate according to the reference gray level, the initial emission duty cycle, the pulse count, a frame rate of the display panel, and the number of emission pulses per data frame.

6. The display driver circuit of claim 1, wherein the emission optimization circuit generates a duty cycle of the compensated emission signal according to the initial emission duty cycle and the emission compensation estimate.

7. The display driver circuit of claim 6, wherein the duty cycle of the compensated emission signal is positively correlated to the reference gray level and the initial emission duty cycle.

8. The display driver circuit of claim 1, wherein the reference gray level is a predetermined value.

9. The display driver circuit of claim 1, wherein the reference gray level is an average gray level of a predetermined range in a previous data frame.

10. A method of operating a display driver circuit to control a display panel, the display driver circuit comprising an emission compensation circuit and an emission optimization circuit, the method comprising:

the emission compensation circuit generating an emission compensation estimate according to at least a reference gray level, an initial emission duty cycle, and a pulse count of a number of emission pulses in a data frame of the display panel; and the emission optimization circuit generating a compensated emission signal according to the initial emission duty cycle and the emission compensation estimate, and drive the display panel according to the compensated emission signal.

11. The method of claim 10, wherein:

the emission compensation circuit comprises a memory and an interpolation circuit, the memory comprising a first lookup table storing a data pair of the pulse count and a corresponding emission compensation estimate for a first luminance, and a second lookup table storing a data pair of the pulse count and a corresponding emission compensation estimate for a second luminance;

the emission compensation circuit generating the emission compensation estimate according to at least the reference gray level, the initial emission duty cycle, and the pulse count of the number of emission pulses in the data frame of the display panel comprises:

the emission compensation circuit multiplying the reference gray level and the initial emission duty cycle to generate a target luminance; and the interpolation circuit checking the first lookup table according to the pulse count to determine the corresponding emission compensation estimate for the first luminance, and checking the second lookup table according to the pulse count to determine the corresponding emission compensation estimate for the second luminance, and the interpolation circuit performing an interpolation between the corresponding emission compensation estimate for the first luminance and the corresponding emission compensation estimate for the second luminance to generate the emission compensation estimate, the target luminance being between the first luminance and the second luminance.

12. The method of claim 10, wherein the emission compensation circuit generating the emission compensation estimate according to at least the reference gray level, the initial emission duty cycle, and the pulse count of the number of emission pulses in the data frame of the display panel comprises:

the emission compensation circuit generating the emission compensation estimate according to the reference gray level, the initial emission duty cycle, the pulse count, and a frame rate of the display panel.

13. The method of claim 10, wherein the emission compensation circuit generating the emission compensation estimate according to at least the reference gray level, the initial emission duty cycle, and the pulse count of the number of emission pulses in the data frame of the display panel comprises:

the emission compensation circuit generating the emission compensation estimate according to the reference gray level, the initial emission duty cycle, the pulse count, and the number of emission pulses per data frame.

14. The method of claim 10, wherein the emission compensation circuit generating the emission compensation estimate according to at least the reference gray level, the initial emission duty cycle, and the pulse count of the number of emission pulses in the data frame of the display panel comprises:

the emission compensation circuit generating the emission compensation estimate according to the reference gray level, the initial emission duty cycle, the pulse count, a frame rate of the display panel, and the number of emission pulses per data frame.

15. The method of claim 10, wherein the emission optimization circuit generating the compensated emission signal according to the initial emission duty cycle and the emission compensation estimate, and drive the display panel using the compensated emission signal comprises:

the emission optimization circuit generating a duty cycle of the compensated emission signal according to the initial emission duty cycle and the emission compensation estimate.

16. The method of claim 15, wherein the duty cycle of the compensated emission signal is positively correlated to the reference gray level and the initial emission duty cycle.

17. The method of claim 10, wherein the reference gray level is a predetermined value.

18. The method of claim 10, wherein the reference gray level is an average gray level of a predetermined range in a previous data frame.

* * * * *